US006290268B1

(12) United States Patent
Cohen et al.

(10) Patent No.: US 6,290,268 B1
(45) Date of Patent: Sep. 18, 2001

(54) DUAL ROTARY LATCH

(75) Inventors: Victor I. Cohen, Agoura; Robert F. Helenick, Simi Valley, both of CA (US)

(73) Assignee: Hehr International, Inc., Los Angeles, CA (US)

( * ) Notice: Subject to any disclaimer, the term of this patent is extended or adjusted under 35 U.S.C. 154(b) by 0 days.

(21) Appl. No.: 09/369,575

(22) Filed: Aug. 6, 1999

Related U.S. Application Data

(60) Provisional application No. 60/095,517, filed on Aug. 6, 1998.

(51) Int. Cl.[7] ..... E05C 7/00

(52) U.S. Cl. ..... 292/48; 292/196; 292/DIG. 23

(58) Field of Search ..... 292/3, 8, 11, 24–26, 292/30, 48, 32–36, 41, 56, 196, DIG. 3, DIG. 31

(56) References Cited

U.S. PATENT DOCUMENTS

| | | | | |
|---|---|---|---|---|
| 1,867,776 | * | 7/1932 | Stuart | 292/48 |
| 2,839,912 | * | 6/1958 | Corbin | 70/141 |
| 2,926,943 | * | 3/1960 | Leslie | 292/53 |
| 4,273,368 | * | 6/1981 | Tanaka | 292/53 |
| 5,069,491 | * | 12/1991 | Weinerman | 292/48 |
| 5,127,686 | | 7/1992 | Gleason et al. | 292/336.3 |
| 5,595,076 | * | 1/1997 | Weinerman | 70/208 |
| 5,722,704 | * | 3/1998 | Chaput | 292/26 |
| 6,059,352 | * | 5/2000 | Heldt | 296/146.6 |

OTHER PUBLICATIONS

TRI/Mark; TRI/Mark Designers & Manufacturers of Vehicle Hardware Products; dated No. 6/96–3; pp. 1, 14 and 26; Printed in USA.

* cited by examiner

*Primary Examiner*—Gary Estremsky

(57) ABSTRACT

A dual rotary latch assembly installed in the door of an RV and comprising two rotary latches spaced apart along the free edge of the door and connected by a linkage embedded in the door to open the upper latch along with the lower latch but slightly in advance thereof. The linkage includes a slide mounted on the lower latch with a lost-motion connection and connected to the trip lever of the lower latch to be moved thereby, a spring-loaded adjustable connection between the slide and an elongated link, for adjusting the timing of the operation of the upper latch, and a pivotal connection between the link and the trip lever of the upper latch, to move this to the unlatching position during the movement of the trip lever of the lower latch toward its unlatching position. The spring for the linkage can be selected to resist 30 "G" dynamic forces.

12 Claims, 2 Drawing Sheets

DUAL ROTARY LATCH

REFERENCE TO PRIOR PROVISIONAL APPLICATION

This application claims the benefit of prior copending provisional application number 60/095,517, filed Aug. 6, 1998.

BACKGROUND OF THE INVENTION

This invention relates to door latches, and relates particularly to latches that are usable to hold doors of vehicles such as recreational vehicles ("RV's") releasably in closed positions. The invention is particularly useful in RV's in which specially shaped doors create special problems of secure latching.

There is a real need for an improved latch assembly that will hold the doors of RV's and similar vehicles securely and tightly closed during high-speed highway travel, and also in case of accidents that can lead to overturning or even rolling of the vehicle. A particular problem exists for doors of irregular shapes such as the "cab" doors where one side portion of the door follows the slope of the windshield and thus does not lie along the hinge axis of the door. The upper portion of the sloped side of such a door cannot be hinged directly to the frame.

The present invention has as its principal objective the provision of a novel latch assembly for the secure latching of such a door, the latch assembly being smooth and easy to operate, capable of being concealed, and highly effective to secure the door releasably in the closed position.

BRIEF SUMMARY OF THE INVENTION

The present invention resides in a novel dual latch assembly that utilizes two similar latches in positions spaced along the free edge of the door, one being selectively operable and positioned in the standard latch location and the other being positioned along the upper portion of the free edge, with a simple and effective operating connection between the latches that may be concealed inconspicuously in the door. This connection transmits the opening motion of the operator of the lower latch to the upper latch and opens the upper latch immediately before opening of the lower latch. The novel latch assembly, which may utilize two basically conventional latches, also is resistant to unlatching in high "G" turns of the type sometimes encountered in accidents, and is designed for smooth unlatching and relatching of the door in a manner that is not apparent to the user.

For these purposes, the preferred embodiment of the latch assembly of the invention uses two rotary latches that may be of the general type shown in U.S. Pat. No. 5,127,686 spaced apart along the free edge of the door, and connects those latches with an elongated linkage that is inconspicuously embedded in the body of the door and has motion-transmitting connections to the latches at each end. Between the latches, the linkage includes a spring-loaded lost-motion connection including a spring yieldably resisting movement of the linkage in the unlatching direction, thereby permitting the upper latch to be opened just before the lower latch is opened. The spring is effective to resist accidental unlatching of the second latch by "G" forces that may be applied to the linkage during rolling of the RV, and the connection includes a simple adjustment mechanism for setting the trigger point of the upper latch relative to the lower latch.

A feature of the invention is the manner of adapting the conventional latches, as sold by Tri/Mark Corporation under the above-identified patent, for use in the invention, by adding a slide alongside the patented latch as part of the linkage to be moved by the existing trip lever of the latch, and incorporating the spring-loaded and adjustable connection between this slide and the remainder of the linkage.

Other features and advantages of the invention will be apparent from the accompanying detailed descriptions, taken in conjunction with the drawings, in which:

DETAILED DESCRIPTION

Figure 1:
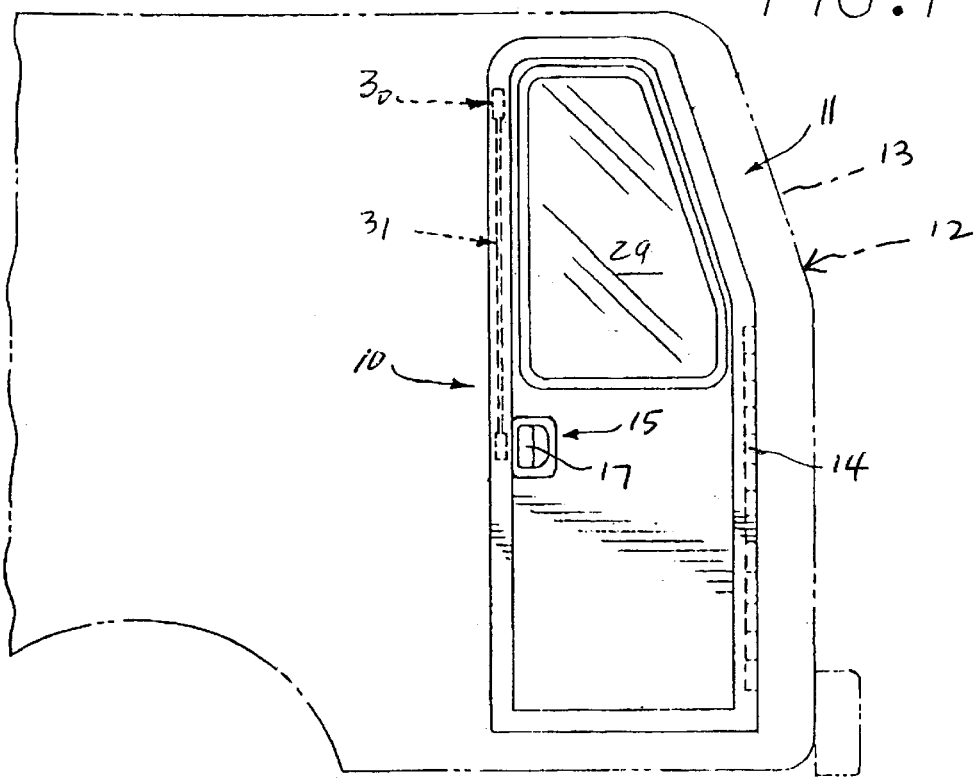
FIG. 1 is a side elevation of a representative vehicle door equipped with a dual latch assembly in accordance with the invention, the partial outline of a vehicle being shown in broken lines.
Figure 2:
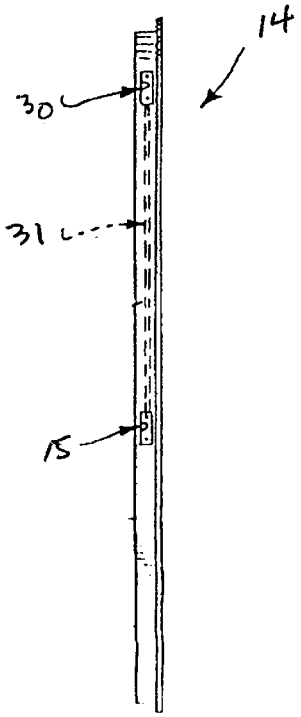
FIG. 2 is an edge elevation of the door, taken from the left side of FIG. 1, showing the positions of two latches in the door.

As shown in the drawings for purposes of illustration, the invention is an improvement in a rotary latch assembly 10 that is installed in a door 11 of a recreational vehicle, the partial outline of which is shown in FIG. 1 at 12. The illustrative vehicle is of the type that has a sloping front side in the windshield area 13, and the illustrative door is mounted close to this front side for entry into the front "cab" portion of the vehicle, on a hinge 14 along the front edge of the door. A door handle assembly 15 is located along the free trailing side of the door as part of the latch assembly 10, to secure the door releasably in the closed position shown in FIG. 1. This handle assembly typically is in the lower or central portion adjacent to the free edge of the door, for easy access by the user, and herein includes a paddle handle 17 that is pulled outwardly by the user to unlatch the door.

The latch assembly 10 and the handle assembly 15 of the preferred embodiment of the invention are of the type sold by Tri/Mark Corporation as its 30–900 Series under U.S. Pat. No. 5,127,686, entitled "Door Closure Assembly", and are shown only generally herein. Reference is made to the patent for a full disclosure of the construction and operation of the latch.

The latch assembly 10 of the patent is of a well known type that is held open when the door is open and latches automatically and positively as an incident to closing of the door, as described in detail in the patent. In general, the latch assembly has an open side 18 facing toward the door frame, the right side as viewed in FIG. 3, that is engaged upon closing, and has a latch member in the form of a keeper 19 that is formed with a U-shaped keeper notch 20 for receiving a striker bolt that is positioned on the door frame to enter the keeper notch as the door moves to the closed position. The striker bolt and the other detailed operating elements of the patented latch assembly are not shown herein, but their operation will be described in general, for an understanding of the operation of the invention herein.

Engagement of the striker bolt of the patented latch assembly in the keeper notch 20 rotates the keeper 19 into a latched position, against the action of a keeper spring (not shown) that urges the keeper toward the open position. When the keeper reaches the latched position, a spring-loaded catch engages the keeper to hold it positively in the latched position until the catch is disengaged by a latch operator that is connected to the door handle 17 and an inner handle, only the outer handle 17 is being shown herein.

Figure 3:
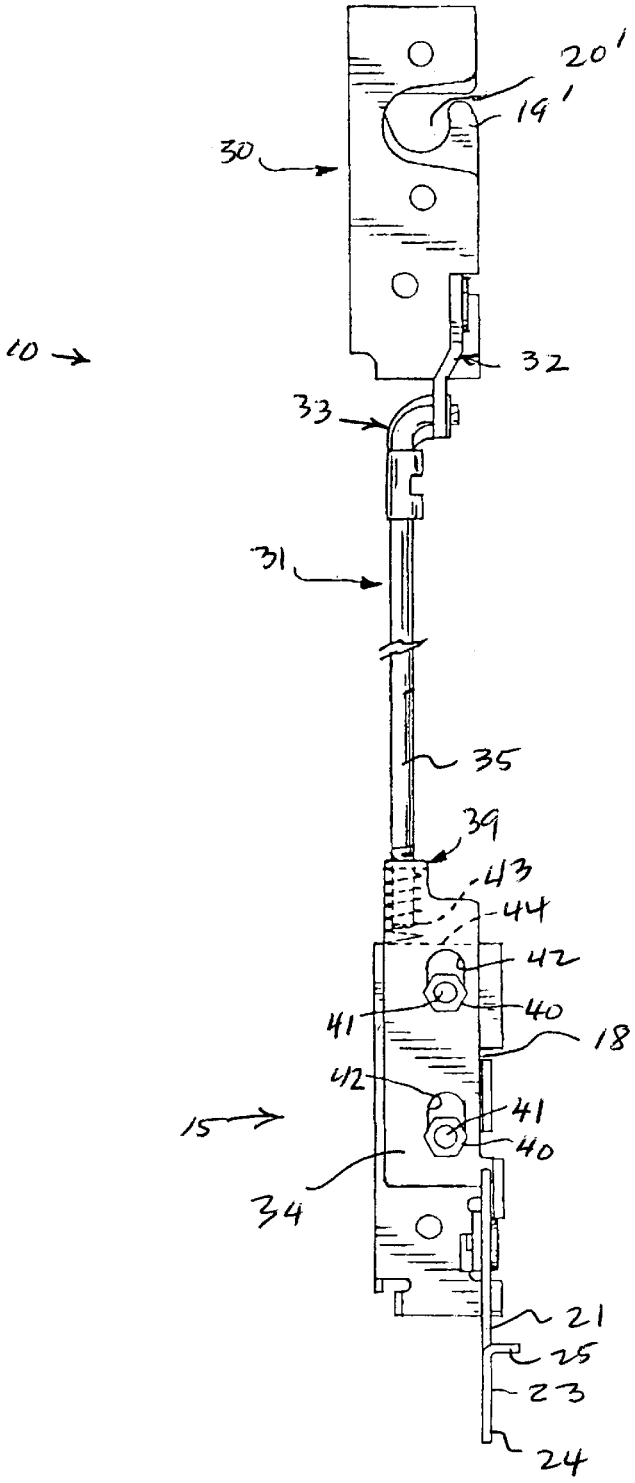
FIG. 3 is an enlarged isolated elevational view of selected portions of the two latches and the linkage of the dual latch assembly that is embedded in the door of FIGS. 1 and 2, the latches being shown in the latched positions.
Figure 4:
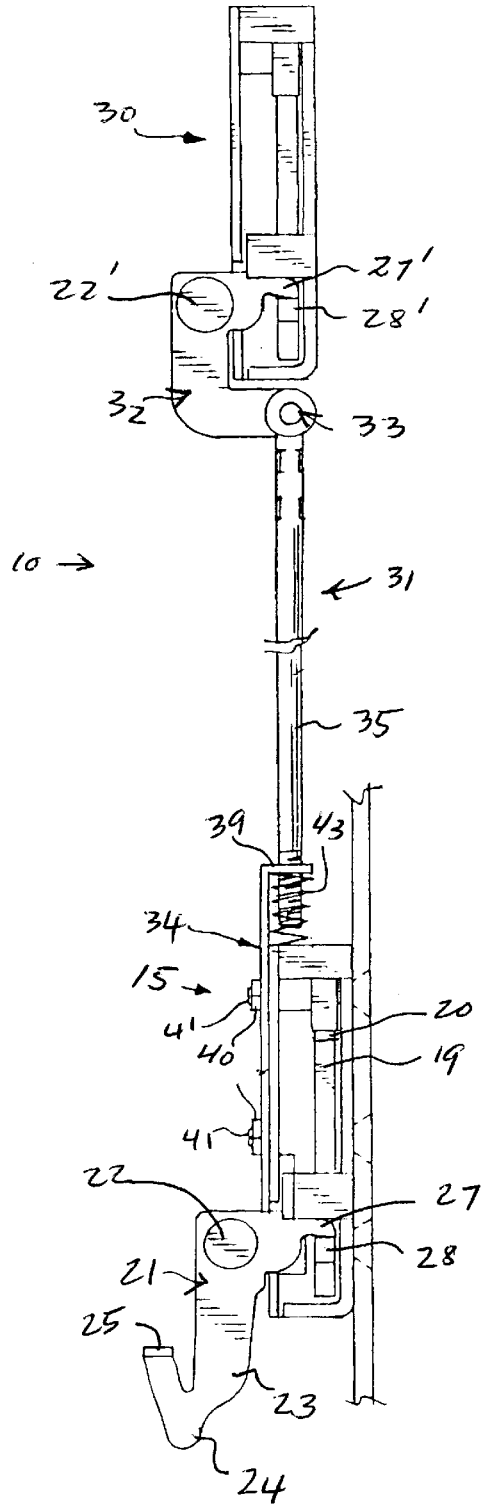
FIG. 4 is a view of the parts in FIG. 3, taken from the right-hand side thereof.

The latch operator of the patented latch assembly 10 includes a trip lever 21, shown in full herein in FIGS. 3 and 4, mounted on a pivot 22 and having a depending leg 23 formed with input elements in the form of a finger 24 and a projection 25, for connection to the door handles to turn the trip lever in an unlatching direction upon "opening" movement of one of the handles. As shown herein, the unlatching movement of the trip lever is clockwise rotation (FIG. 4) about the pivot 22. The trip lever also has an output element for releasing the latch member to move to the unlatching position in response to such movement of the trip lever, the output element of the patented latch assembly being a finger or "tang" 27 that projects to the right and overlies a release arm 28 when the latch is in the latched position. Clockwise rotation of the trip lever 21 toward the unlatching position presses the tang down against the release arm, and this releases the keeper 19 to the opening action of its spring. Reference is made to the aforesaid patent for further details of construction and operation of such a latch.

It can be seen that the door 11, which is illustrative of various doors in which the invention may be used, has a window 29 in its upper area, substantially filling the space above the latch assembly 15, except for narrow marginal borders for the door and window frames. The problem addressed by this invention is the secure latching of the upper portion of doors such as this one, and in particular the secure latching of such a door in a manner that will hold the door closed in accidents that develop relatively high "G" forces tending to overcome the latch.

In accordance with the invention, a second, conventional latch assembly 30, which may be of the same general kind as the lower latch assembly 15, is set into the free edge of the door 10 in the upper area to be latched, and is connected to the latch assembly 15, for operation substantially in unison by a hidden linkage 31 that is embedded in the door and connected to the two latch assemblies to transmit the unlatching motion of the operator of the lower latch assembly to the operator of the upper latch assembly. For convenience, the upper and lower latch assemblies 15 and 30 hereinafter are referred to simply as latches constituting components of the improved dual latch assembly 10.

Herein, the preferred embodiment of the upper latch 30 also is a conventional latch that operates in accordance with the aforesaid patent, being sold by Tri/Mark Corporation as Part No. PR15855. This type of latch has an operator in the form of a trip lever 32 that is similar to the trip lever 21, except that its input is from the linkage 31 at a pivot joint 33 connecting the linkage to the trip lever 32. In other respects, the upper latch 30 may be the same as the lower latch 15 including a finger or tang 27' on the trip lever 32 overlying a release arm 28' that is operable, when pressed down, to release the keeper 19' to the action of its spring and to move to the open or unlatching position. Shown in FIG. 3 is the latching or closed position of the keeper. Corresponding primed reference numbers are used for corresponding parts of the upper latch 30.

As can be seen in FIGS. 3 and 4, the linkage 31 of the presently preferred embodiment of the invention comprises a slide 34 that is movably mounted on the housing of the lower latch 15, and an elongated rod 35 that is joined at its lower end to the slide and at its upper end to the pivot joint 33. The slide is a substantially flat plate, shown separately in FIG. 6, disposed against the side of the latch housing and having an offset guide flange 37 that wraps around the housing on the right-hand side, as viewed in FIG. 3, in the area of the housing that is shown in cross-section in FIG. 5, and extends downwardly alongside the tang 27 of the trip lever 21. A tab 38 on this guide flange projects under the tang to be engaged by the latter as it moves clockwise (FIG. 4) and downwardly during movement to the unlatching position. This can be seen most clearly beneath the tang in FIG. 4.

The slide plate 34 has an adjustable connection to the rod 35, to permit adjustment of the effective length of the linkage 31 and to thereby selectively adjust the timing of the release of the upper latch 30 relative to the lower latch 15. This is accomplished simply and easily by providing a mounting bracket 39 on the upper end of the slide plate with a threaded connector receiving the lower end portion of the rod. Simply by adjusting the rod in this connector, the length between the tab 38 and the pivot 33 will be changed. It will be evident that a similar threaded adjustment could be provided between the upper end of the rod and the pivot 33, or in an intermediate portion of the rod.

The slide plate 34 is movably mounted on the side of the Tri/Mark latch 15 by two "Pem" nuts 40 that are threaded onto two screws 41 set into the latch housing, the "Pem" nuts being disposed in two elongated slots 42 in the plate. These slots are elongated in the direction of unlatching movement, vertically in this instance, to permit limited up-and-down movement of the slide plate 34 relative to the lower latch 15.

The adjustable connection includes spring means acting between the lower latch 15 and the slide plate 34 to urge the latter yieldably toward the upper latch 30 and to normally hold the slide in a raised position in the slots. In this case, this means is a coiled compression spring 43 that is confined between the bracket 39 and the upper end 44 of the lower latch housing. The spring is telescoped over the lower end portion of the rod 35, beneath the threaded connector. This spring thus resists downward, unlatching movement of the linkage 31, but is yieldable under the positive unlatching force of the lower trip lever 21 to permit such movement.

The spring 43 is selected to be sufficiently strong to resist downward movement of the linkage 31 in response to high "G" dynamic forces that may be encountered in operation, including in accidents. This linkage is designed to resist up to a 30 "G" force, as specified in SAEJ839 (Rev. Jun. 91). For this purpose, the spring must be able to support 30 times the weight of the linkage. This can be accomplished with a relatively light spring.

Figure 5:
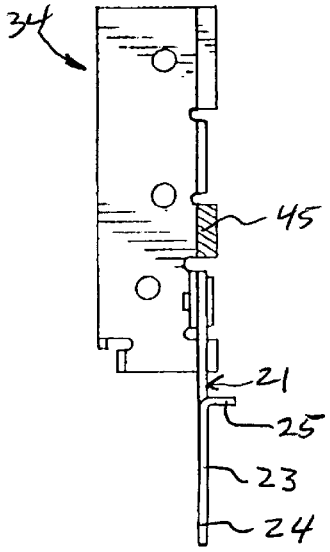
FIG. 5 is an elevational view of the body of the conventional lower latch, alone, showing in broken lines the area where a modification is made to accommodate the slide plate of this invention.
Figure 6:
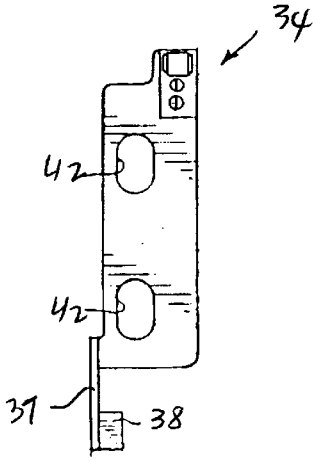
FIG. 6 is an elevational view of the slide plate alone.

The cross-sectional area 45 shown on FIG. 5, where the guide flange 37 bends around the latch housing, is the location of the only modification that is needed in the standard Tri/Mark latch for the present invention. Some of the original material is removed at this point to permit the slide 34 to bend around the housing and move relative thereto.

It is to be noted that the operating linkage 31 can be set for opening of the upper latch 30 just before the lower latch 15 opens, thus avoiding any possibility of interference with normal, smooth opening of the door 11. The difference can be so slight as to be imperceptible in operation at normal speed, but sufficiently in advance to ensure that the upper portion of the door is free to open when the lower portion is pulled open at the handle 17.

In this respect, the length of the linkage 31 should be adjusted so that the lower trip lever 21 moves the upper trip lever 32 to its unlatching position before the lower trip lever arrives at its unlatching position. This can be established by shortening the linkage to set the upper tang 27' tightly against the upper release lever 28' while, at the same time, lifting the slide tab 38 under the lower tang 27 slightly, even creating a small clearance (not shown) between the lower tang 27 and the lower release lever 28 for a timing delay.

With the foregoing dual rotary latch assembly 10, the upper latch 30 acts with the lower latch 15 to hold the closed door 11 securely in place, and the spring 43 can be selected to meet the 30 "G" safety requirement previously mentioned. When the door is to be opened, the handle 17 of the lower latch 15 is grasped and operated in the usual fashion, and the opening movement of the handle is transmitted to the lower trip lever 21 to move it from its latching position toward its unlatching position, at the same time moving the slide plate 34 and the rod 35 to rock the upper trip lever 32 toward its unlatching position. With the timing adjusted in the desired manner, the upper latch 30 will open just before the lower latch 15 opens, thereby ensuring smooth operation. Both latches will remain open and in the unlatching positions, as described in the patent, until the door is closed, and then both will close and relatch automatically as an incident to engagement of the keepers 19 and 19' with the striker bolts on the door frame.

From the foregoing, it will be seen that the invention provides a novel combination of two latches that may be conventional, with a motion-transmitting linkage that may be embedded and concealed in the core of the door and adjusted for smooth operation. At the same time, the latches securely and effectively latch the closed door.

It also will be apparent that, while a preferred embodiment of the invention has been illustrated and described in detail, various modifications and changes may be made by those skilled in the art without departing from the spirit and scope of the invention.

We claim as our invention:

1. In a door latching assembly having a first latch having a first latch element rotatable between latching and unlatching positions and yieldably urged toward the unlatching position, and a first trip lever rotatable between latched and unlatching positions and operable during such rotation to release the first latch element to rotate to the unlatching position, the improvement which comprises:

a second, similar latch spaced from said first latch and having a second latch element rotatable between latching and unlatching positions, and a second trip lever rotatable between latched and unlatching positions and operable during such rotation to release the second latch element to rotate to the unlatching position;

a slide disposed alongside said first latch;

means mounting said slide on said first latch for relative movement thereon toward and away from said second latch between first and second limited positions;

an elongated link connected adjacent one end of the link to said slide and adjacent the other end of the link to said second trip lever for movement of the second trip lever in response to movement of the slide relative to said first latch;

spring means acting between said first latch and said slide to urge the latter yieldably toward said second latch and into the first limited position;

means permitting selective adjustment of the effective length of said link thereby to set the timing of movement of the second latch element to the unlatching position;

and a connection between said first trip lever and said slide for transmitting rotary motion of the first trip lever from the latched position toward the unlatching position to the slide and through the link to the second trip lever, thereby to move the second trip lever to the unlatching position during such motion.

2. A door latching assembly as defined in claim 1 wherein said slide has a bracket on one end, closest to said second latch, and said spring means comprise a coiled compression spring acting between said bracket and said first latch to urge the slide toward the second latch.

3. A door latching assembly as defined in claim 2 wherein said means permitting selective adjustment comprise a threaded end portion received in a threaded bracket for threaded adjustment of the effective length of the link.

4. A door latching assembly as defined in claim 1 wherein said means mounting said slide comprises at least one fastener secured to said first latch and extending through an elongated slot in said slide to permit relative movement of the fastener along the slot and guiding the slide on said fastener.

5. A door latching assembly as defined in claim 1 wherein said slide is a flat plate disposed alongside said first latch and carrying a tab disposed in side-by-side relation with said trip lever, said tab and said trip lever having opposed surfaces for moving said slide toward said second latch as said trip lever moves from the latched position toward the unlatching position.

6. A door latching assembly as defined in claim 1 wherein said trip lever has an outwardly projecting finger movable away from said second latch during such motion, and said slide has an abutment disposed in the path of said finger to be engaged and moved in the same direction far enough to move the second trip lever to its unlatching position before the first trip lever reaches its unlatching position.

7. In a door latching assembly comprising a first latch having a latch element movable between latching and unlatching positions, and a latch operator selectively movable between latched and unlatching positions and operable during such movement to cause the latch element to move to the unlatching position, the improvement which comprises:

a second similar latch having a second latching element movable between latching and unlatching positions, and a second latch operator movable between latched and unlatching positions and operable during such movement to cause the second latch element to move to the unlatching position;

and a linkage connecting said second operator to said first operator and transmitting motion of the first operator to the second operator, thereby to operate the latches together, said linkage comprising a slide mounted on said first latch for movement toward and away from said second latch, a first connection on said first operator for moving said slide in one direction as the first operator moves to the unlatching position, an elongated link connected to said slide and extending to said second operator, a second connection between said link and said second operator for moving said second operator in the unlatching direction as said first operator moves in the unlatching direction, a lost-motion connection between said slide and said first latch, and means yieldably urging said slide in the direction of said second latch and holding said first operator yieldably away from the unlatching position.

said linkage being operable to unlatch the second latch as the first latch is being unlatched.

8. A door latching assembly as defined in claim 7 wherein said means yieldably urging said slide is a spring acting between the slide and the first latch.

9. A door latching assembly as defined in claim 8 wherein said slide has an abutment constituting said first connection, and holds said first operator in spaced relation with the unlatching position.

10. A door latching assembly as defined in claim 7 further including means for selectively adjusting the effective length of said linkage and thereby setting the timing of the second latch relative to the first latch.

11. A door latching assembly as defined in claim 10 wherein said means for selectively adjusting the effective length is a threaded connection in said linkage.

12. A door latching assembly as defined in claim 7 wherein said slide is mounted on said first latch with a lost-motion connection permitting relative movement toward and away from said second latch, and further including spring-means yieldably urging said slide in the latching direction and yieldably permitting relative movement in the unlatching direction, and means for adjusting the effective length of said link to adjust the timing of said latches.

* * * * *